US006565396B2

(12) United States Patent
Saka et al.

(10) Patent No.: US 6,565,396 B2
(45) Date of Patent: May 20, 2003

(54) FEMALE TERMINAL FITTING

(75) Inventors: Yukinori Saka, Yokkaichi (JP); Koji Okutani, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 09/870,747

(22) Filed: Jun. 1, 2001

(65) Prior Publication Data

US 2001/0051471 A1 Dec. 13, 2001

(30) Foreign Application Priority Data

Jun. 9, 2000 (JP) ..... 2000-174002

(51) Int. Cl.[7] ..... H01R 13/187
(52) U.S. Cl. ..... 439/843; 439/491
(58) Field of Search ..... 439/843, 842, 439/748, 839, 489, 490, 491

(56) References Cited

U.S. PATENT DOCUMENTS 5,599,212 A 2/1997 Sawada ..... 439/843
5,951,314 A * 9/1999 Durand-Cochet et al. ... 439/252
6,186,840 B1 * 2/2001 Geltsch et al. ..... 439/843

FOREIGN PATENT DOCUMENTS

| | | | |
|---|---|---|---|
| EP | 223 586 | 5/1987 | |
| EP | 386 742 | 9/1990 | |
| EP | 869 583 | 10/1998 | |
| WO | WO 89/05531 | * 6/1989 | ..... H01R/13/11 |

* cited by examiner

*Primary Examiner*—P. Austin Bradley
*Assistant Examiner*—Alexander Gilman
(74) *Attorney, Agent, or Firm*—Banner & Witcoff, Ltd.

(57) ABSTRACT

The invention makes it possible to distinguish between a plurality of types of female terminal fittings. A gold-plated female terminal fitting 10Au is formed by attaching a shell 20 to a terminal main body 11, and a tin-plated female terminal fitting 10Sn is formed by attaching a shell 30 to the same kind of terminal main body 11 as used for the gold-plated female terminal fitting. The shells 20 and 30 for the gold-plated female terminal fitting and the tin-plated female terminal fitting, respectively, are provided with mutually differing distinguishing means 22, 24, 25, 26, 30, 32, and 34. The gold-plated female terminal fitting 10Au and the tin-plated female terminal fitting 10Sn can be distinguished from one another on the basis of these distinguishing means 22, 24, 25, 26, 30, 32, and 34.

5 Claims, 5 Drawing Sheets

FEMALE TERMINAL FITTING

TECHNICAL FIELD

The present invention relates to a female terminal fitting wherein a terminal main body has a shell attached to its exterior.

BACKGROUND TO THE INVENTION

One example of a female terminal fitting wherein a terminal main body has a shell attached to its exterior is described in U.S. Pat. No. 5,599,212. In this example, a shell is attached to the exterior of a terminal main body provided with an electric wire contacting member and resilient contacts, this shell covering the resilient contacts. In applications using this type of female terminal fitting, one of two types of female terminal fitting can be housed within a housing: a female terminal fitting having either a tin-plated terminal main body or a gold-plated terminal main body. In signal circuits requiring a high degree of contact reliability, such as air bag circuits, the gold-plated female terminal fittings are used. In other circuits requiring a lower degree of contact reliability, tin-plated female terminal fittings are used.

Conventionally, tin-plated female terminal fittings and gold-plated terminal fittings use identical main bodies and shells. It is however somewhat difficult to visually distinguish between these identical main bodies even if they have been plated with different metals. The present invention has taken the above problem into consideration, and aims to make it possible to distinguish between a plurality of types of female terminal fittings.

SUMMARY OF THE INVENTION

According to the invention there is provided a female terminal fitting comprising a main body having a connection region for attachment to an electric wire, and a resilient contact for engaging a male terminal fitting, said terminal fitting further including a shell adapted to receive and cover said resilient contact, wherein said shell is one of a plurality of types of shells, each type of shell having a physical distinguishing feature. Such an arrangement makes it possible to distinguish visually and/or by touch between one shell and another.

Preferably each type of shell is rectangular in section and box-like, and each type of shell may have a common mouth configuration to guide a mating connector to said terminal.

The distinguishing feature may comprise one or more of the following features: the presence or absence of a protrusion, the presence or absence of an aperture in the wall of the shell, the orientation of a resilient latching arm, the position of an aperture with respect to a latching arm, the absence of an aperture in relation to a latching arm, different outer dimensions of the shells, in particular the width in relation to opposite resilient contacts.

An aperture of the shell may permit movement of a resilient contact therein, thereby permitting the terminal fitting to be narrower than if a bending space for the resilient contact was provided wholly within the shell.

The invention also provides a method of distinguishing female terminal fittings comprising a main body having a connection region for attachment to an electric wire, and a resilient contact for engaging a male terminal fitting, and a shell adapted to receive and cover said resilient contact, the method comprising the steps of providing a plurality of different types of shell, each type of shell having different physical features to permit the shell type to be distinguished.

BRIEF DESCRIPTION OF DRAWINGS

Other features of the invention will be apparent from the following description of a preferred embodiment shown by way of example only in the accompanying drawings in which.

DESCRIPTION OF PREFERRED EMBODIMENT

Figure 1:
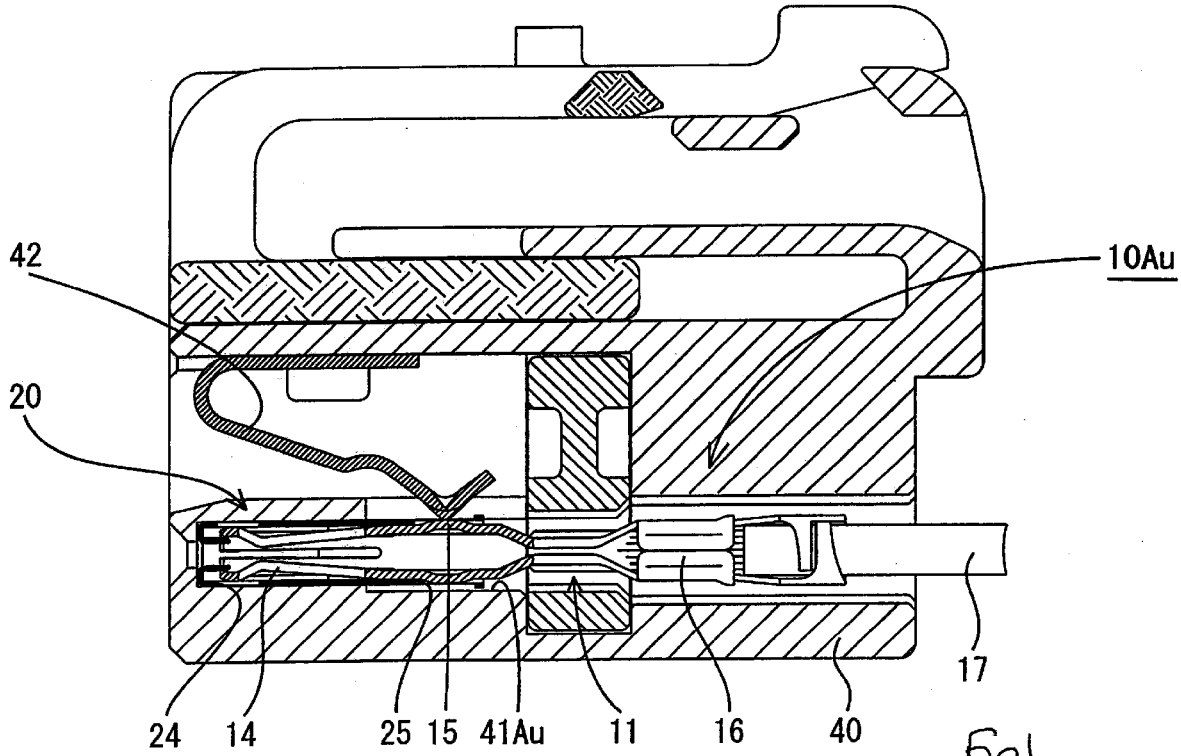
FIG. 1 is a cross-sectional view showing a gold-plated female terminal fitting of an embodiment of the invention in an inserted state within a cavity of a housing.
Figure 2:
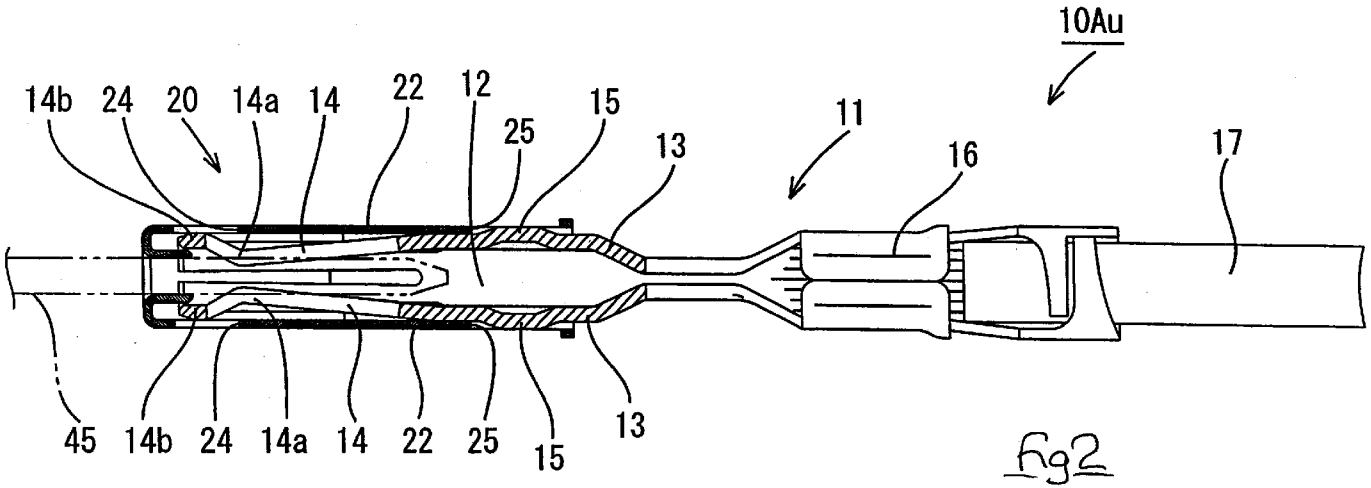
FIG. 2 is a partially cut-away plan view of the gold-plated female terminal fitting.
Figure 3:
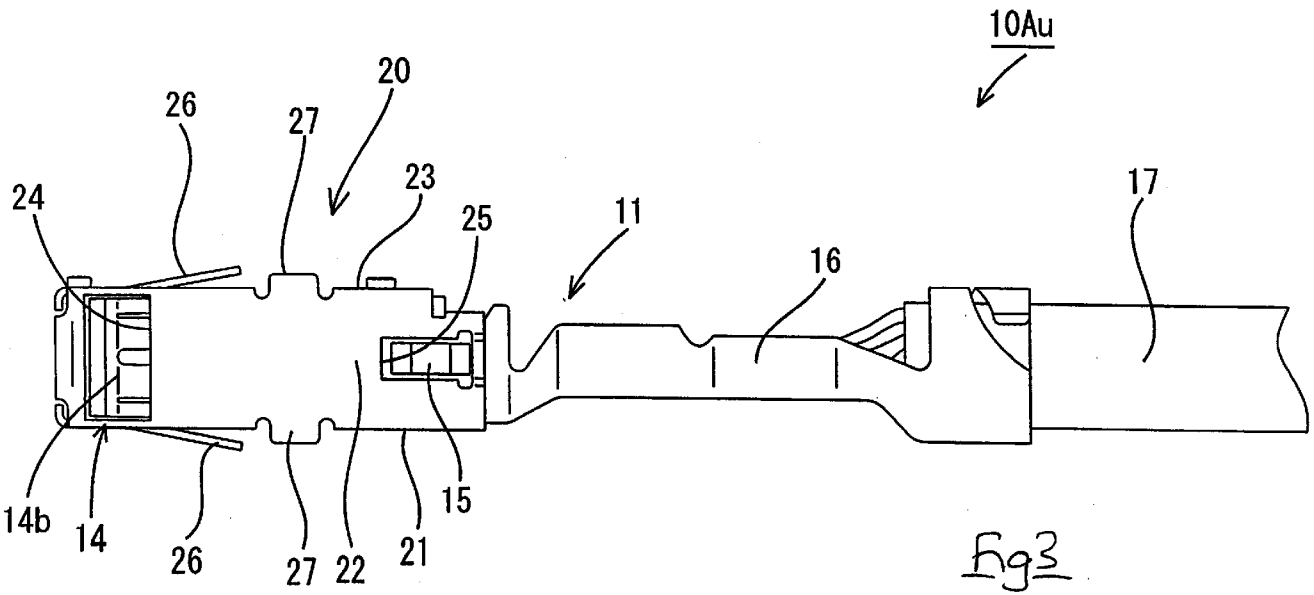
FIG. 3 is a side face view of the gold-plated female terminal fitting.
Figure 8:
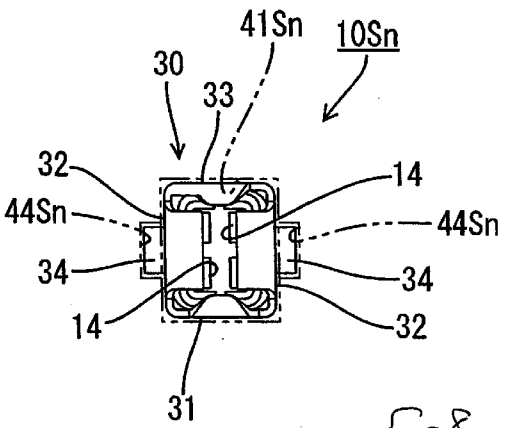
FIG. 8 is a front view of the tin-plated female terminal fitting.
Figure 9:
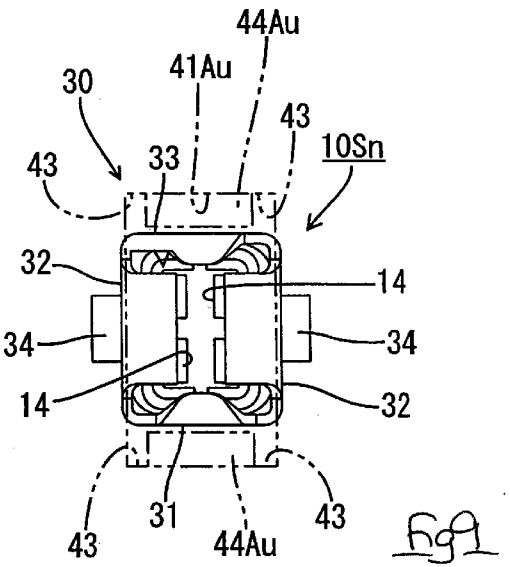
FIG. 9 is a front view showing differences in shape and size of cavities into which the tin-plated female terminal fitting and the gold-plated female terminal fitting are inserted.
Figure 4:
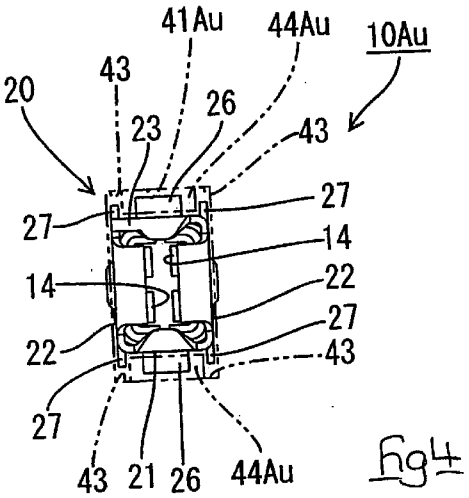
FIG. 4 is a front view of the gold-plated female terminal fitting.
Figure 5:
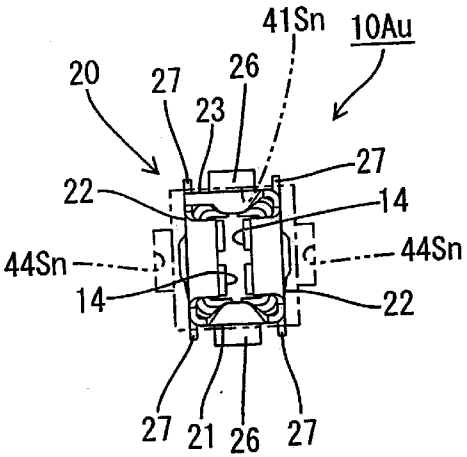
FIG. 5 is a front view showing differences in shape and size of the cavities into which the gold-plated female terminal fitting and a tin-plated female terminal fitting are inserted.
Figure 6:
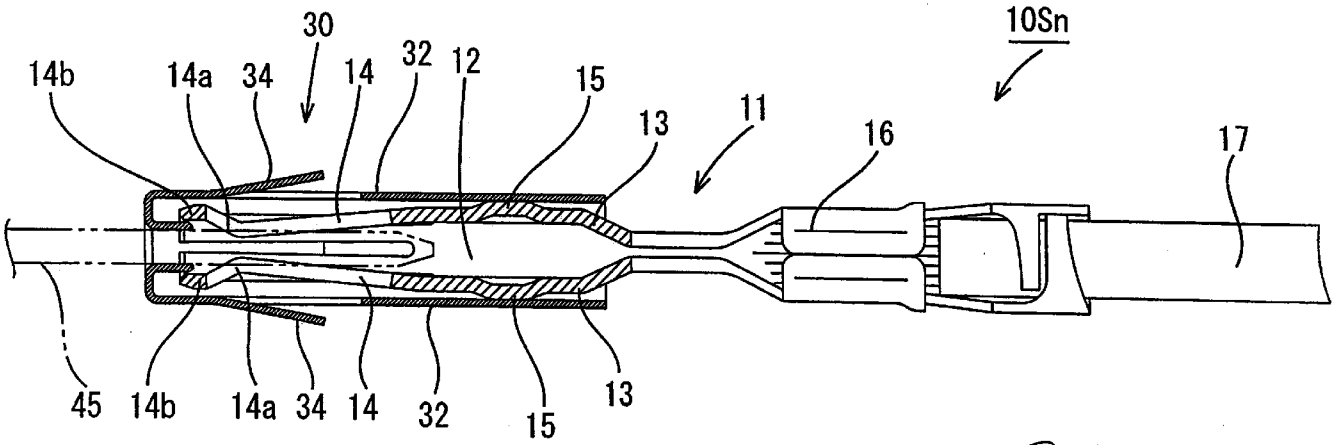
FIG. 6 is a partially cut-away plan view of the tin-plated female terminal fitting.
Figure 7:
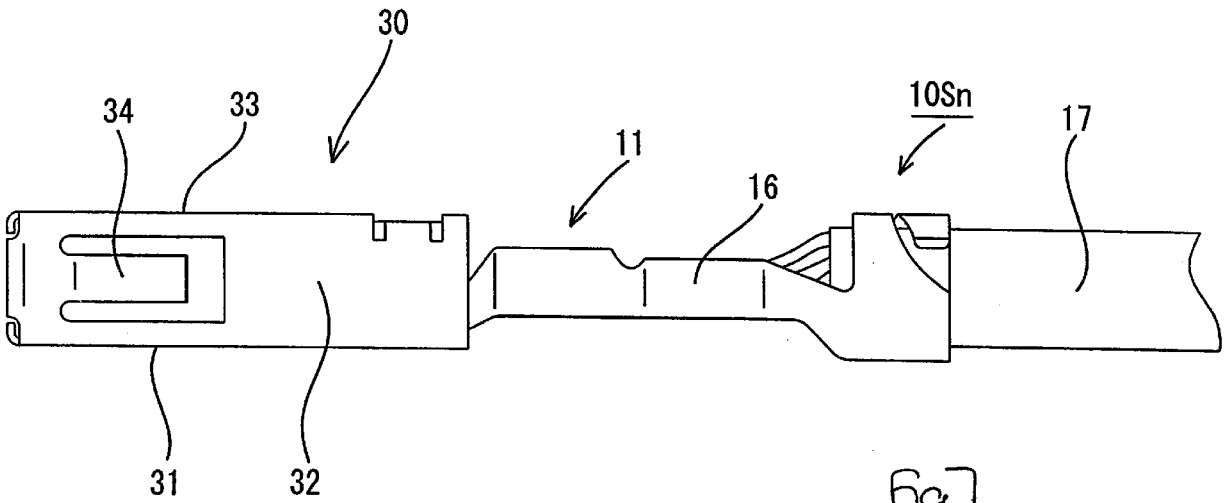
FIG. 7 is a side face view of the tin-plated female terminal fitting.
Figure 10:
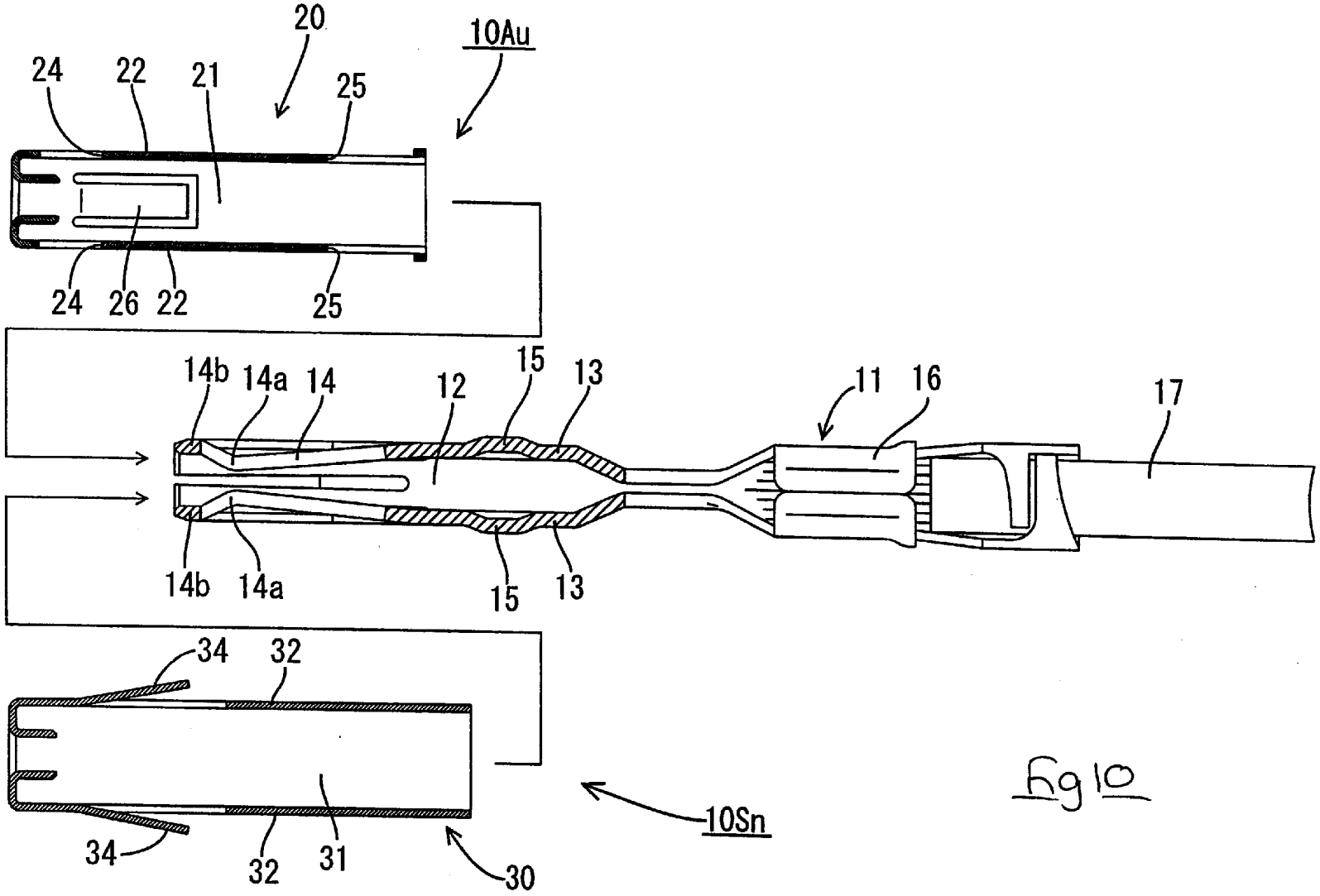
FIG. 10 is a partially cut-away plan view showing a shell for the gold-plated female terminal fitting, a shell for the tin-plated female terminal fitting, and a terminal main body, these being in a separated state.

An embodiment of the present invention is described below with the aid of FIGS. 1 to 10. Female terminal fittings of the present embodiment exist in two types: a gold-plated female terminal fitting 10Au and a tin-plated female terminal fitting 10Sn. These have a terminal main body 11 which is formed from an electrically conductive metal. The terminal main body 11 comprises an electric wire contacting member 16 which is joined to an electric wire 17 and resilient contacts 14 which make contact with a male tab 45. A metal shell 20 or 30 is attached to the terminal main body 11 so as to cover the resilient contacts 14. The terminal main bodies 11 of the gold-plated female terminal fitting 10Au and the tin-plated female terminal fitting 10Sn are the same. However, the metal shells 20 and 30 are formed as two differing types, one for the gold-plated female terminal fitting 10Au and the other for the tin-plated female terminal fitting 10Sn, thus providing a means for distinguishing between the two. The gold-plated female terminal fitting 10Au can be distinguished by the first shell 20, and the tin-plated female terminal fitting 10Sn can be distinguished by the second shell 30.

The terminal main body 11, which is formed from a metal sheet that is punched out in a specified shape and then bent, has a long and narrow shape in an anterior-posterior direction. A pair of supporting walls 13 rise upwards from left and right edges of a base wall 12 of an anterior portion of the terminal main body 11. A left and right pair of resilient contacts 14 bend inwards form the supporting walls 13. The resilient contacts 14 are long and narrow in an anterior-posterior direction and are formed by being cut out from the supporting walls 13. Posterior ends of the resilient contacts 14 join with the supporting walls 13, the anterior ends thereof extending in a cantilevered shape. The posterior ends of the resilient contacts 14 that join with the supporting walls 13 function as a fulcrum allowing the resilient contacts 14 to bend outwards. These left and right resilient contacts 14 are closest towards one another at the location of bent members 14*a* provided towards their anterior ends. The resilient contacts 14 move outwards as the male tab 45 is inserted between the bent members 14*a,* and the resilient returning force of the resilient contacts 14 causes these resilient contacts 14 and the male tab 45 to join with a prescribed contacting force. Outer faces of anterior ends 14*b* (which are situated to the anterior of the bent members 14*a* of the resilient contacts 14) are located at the same position, relative to the widthwise direction (the left-right direction), as outer faces of the supporting walls 13. Portions of the supporting walls 13 bend outwards to form contacting members 15 capable of making contact with a short circuiting terminal 42. The contacting members 15 protrude outwards relative to outer faces of the supporting walls 13. The distance to which these contacting members 15 protrude is approximately the same as the wall thickness of side walls 22 and 32 of the shells 20 and 30. The contacting members 15 are located towards the posterior (relative to the anterior-posterior direction) of the resilient contacts 14. Approximately the posterior half of the terminal main body 11 comprises the electric wire contacting member 16, which is joined by crimping to the end of the electric wire 17. The surface of the terminal main body 11 is gold-plated or tin-plated. The gold-plated terminal main body 11 is attached to the shell 20, and the tin-plated terminal main body 11 is attached to the shell 30.

The shell 20, which is made from a metal sheet which is stamped out in a prescribed shape and then bent, is long and narrow in the anterior-posterior direction, has an angular tubular shape, and is open at its anterior and posterior end faces. The shell 20 comprises a base wall 21, a pair of side walls 22 that rise upwards from left and right side edges of the base wall 21, and an upper face wall 23 that extends inwards from both edges of the side walls 22 that rise upwards. When the shell 20 has been attached to the terminal main body 11, it covers the resilient contacts 14 and the supporting walls 13. Lower edges and upper edges of the supporting walls 13 make contact with the base wall 21 and the upper face wall 23, thereby preventing the shell 20 from moving up or down relative to the terminal main body 11. The outer faces of the supporting walls 13 make contact with inner faces of the two side walls 22, thereby preventing the shell 20 from moving right or left relative to the terminal main body 11. Moreover, the outer faces of the anterior ends 14*b* of the resilient contacts 14 of the terminal main body 11 are located at the same position, relative to the left-right direction, as the inner faces of the two side walls 22. These side walls 22 are one of the distinguishing means of the present embodiment.

A pair of square holes 24 are formed in the side walls 22. When the terminal main body 11 is in an attached state with these side walls 22, the bent members 14*a* (these being the portions that make contact with the male tab 45) and the anterior ends 14*b* of the resilient contacts 14 are exposed at the outer faces of the shell 20 via the holes 24. The holes 24 have several functions; they allow the bent members 14*a* and the anterior ends 14*b* of the resilient contacts 14 to be exposed; they prevent the bent members 14*a* and the anterior ends 14*b,* which move outwards when the resilient members 14 and the male tab 45 are fitted together, from interfering with the side walls 22; and, by allowing the bent members 14*a* and the anterior ends 14*b* which are moved outwards so as to move into the recessed holes 24, they function as a bending space for the bent members 14*a*. The holes 24 are one of the distinguishing means of the present invention.

Square window holes 25 are formed in the side walls 22 at locations to the posterior of the recessed holes 24. When the shell 20 is in an attached state with the terminal main body 11, the contacting members 15 are exposed to outer faces of the shell 20 via these window holes 25. The window holes 25 have several functions; they allow the contacting members 15 to be exposed; the contacting members 15 that protrude from the supporting walls 13 are inserted into these window holes 25; and outer faces of the contacting members 15 form a unified face with outer faces of the side walls 22. These window holes 25 are one of the distinguishing means of the present embodiment.

An upper and lower symmetrical pair of lances 26 are formed at anterior ends of the base wall 21 and the upper face wall 23. Each lance 26 has a cantilevered shape. An anterior end thereof joins the base wall 21 or the upper face wall 23, and the lance 26 extends, in an inclined manner, outwards and towards the posterior. Each lance 26 is capable of resiliently bending inwards, the anterior end thereof serving as the fulcrum. When the gold-plated female terminal fitting 10Au is inserted into a cavity 41Au of a housing 40, the lances 26 are retained by retaining members 44Au formed on inner walls of the cavity 41Au, thereby maintaining the gold-plated female terminal fitting 10Au in a correctly inserted position. The lances 26 are located to the anterior (in the anterior-posterior direction) relative to the window holes 25. That is, the lances 26 are located further inwards relative to the direction of insertion of the gold-plated female terminal fitting 10Au into the cavity 41Au. These lances 26 are provided on the base wall 21 and the upper face wall 23, whereas the window holes 25 are provided in the side walls 22. That is, the lances 26 and the window holes 25 are provided at locations which, when viewed from the direction of insertion, are mutually separated by 90 degrees. Consequently, when the gold-plated female terminal fitting 10Au is inserted into the cavity 41Au, the lances 26 and the window holes 25 each have separate paths of movement. The lances 26 are one of the distinguishing means of the present embodiment.

Stabilizers 27 are provided on the shell 20. These stabilizers 27 are formed on upper and lower edges of the side walls 22, form a unified face therewith, and extend upwards and downwards, respectively. When the gold-plated female terminal fitting 10Au is inserted into the cavity 41Au, these stabilizers 27 fit into guiding grooves 43 formed in the inner walls of the cavity 41Au, thereby stabilizing the position of the gold-plated female terminal fitting 10Au. These stabilizers 27 are located at an approximately central position (relative to the anterior-posterior direction) between the holes 24 and the window holes 25.

Next, the shell 30 will be described and compared to the shell 20. Like the shell 20, the shell 30 is made from a metal sheet which is stamped out in a prescribed shape and then bent, is long and narrow in the anterior-posterior direction, has an angular tubular shape, and is open at its anterior and posterior end faces. The shell 30 comprises a base wall 31, a pair of side walls 32 that rise upwards from left and right side edges of the base wall 31, and an upper face wall 33 that extends inwards from both edges of the side walls 32 that rise upwards. When the shell 30 has been attached to the terminal main body 11, it covers the resilient contacts 14 and the supporting walls 13. Lower edges and upper edges of the supporting walls 13 make contact with the base wall 31 and the upper face wall 33, thereby preventing the shell 30 from moving up or down relative to the terminal main body 11. The outer faces of the contacting members 15 make contact with inner faces of the two side walls 32, thereby preventing the shell 30 from moving right or left relative to the terminal main body 11. The outer faces of the anterior ends 14*b* of the resilient contacts 14 of the terminal main body 11 are located inwards, relative to the left-right direction, from the inner faces of the two side walls 32. These side walls 32 are one of the distinguishing means of the present invention. The shell 20 described above has a pair of square holes 24 that are formed in the side walls 22 thereof. The bent members 14*a* and the anterior ends 14*b* of the resilient contacts 14 are exposed at the outer faces of the shell 20 via these holes 24. By contrast, the anterior ends of the side walls 32 of the shell 30 are not provided with openings corresponding to the holes 24. Instead, they are provided with a left and right pair of lances 34. These lances 34 are formed at the anterior ends of the side walls 32, join therewith and have a cantilevered shape whereby they extend in an inclined manner outwards and towards the posterior. The lances 34 are capable of resiliently bending inwards, the anterior ends thereof serving as the fulcrum. When the tin-plated female terminal fitting 10Sn is inserted into a cavity 41Sn of the housing 40, the lances 34 are retained by retaining members 44Sn formed on inner walls of the cavity 41Sn, thereby maintaining the tin-plated female terminal fitting 10Sn in a correctly inserted position. The lances 26 of the shell 20 are formed on the base wall 21 and the upper face wall 23. By contrast, the lances 34 are formed on the side walls 32 of the shell 30. That is, the lances 26 and 34 are formed at mutually differing locations on the shell 20 and the shell 30 respectively. The lances 34 of the shell 30 are one of the distinguishing means of the present embodiment.

The square window holes 25 are formed in the posterior portions of the side walls 22 of the shell 20, the contacting members 15 being exposed at outer faces of the shell 20 via these window holes 25. By contrast, the side walls 32 of the shell 30 are not provided with openings corresponding to these window holes 25. Instead, the contacting members 15 remain covered by the side walls 32. Furthermore, the shell 20 is provided with the stabilizers 27. By contrast, the shell 30 is not provided with protrusions corresponding to these stabilizers 27.

Moreover, in the case of the shell 20, since the contacting members 15 enter the window holes 25, the side walls 22 of the shell 20 make contact with the outer faces of the supporting walls 13. By contrast, the side walls 32 of the shell 30 make contact with the outer faces of the outwardly-protruding contacting members 15. As a result, the space between the side walls 32 of the shell 30 is greater than the space between the side walls 22 of the shell 20. In other words, the width of the shell 30 is greater than the width of the shell 20.

Next, the housing 40 will be described. The cavity 41Au and the cavity 41Sn are formed within this housing 40. The short circuiting terminal 42 is provided in the vicinity of the cavity 41Au (see FIG. 1). The horizontal cross-sectional shape (that is, at a right-angle to the direction of insertion) of the opening portion of the cavity 41Au has a width and height such that the shell 20 can enter therein with a suitable clearance but without moving too much. In addition, this opening portion is provided with guiding grooves 43 that correspond to the stabilizers 27. Furthermore, the retaining members 44Au corresponding to the lances 26 (these being formed at the upper and lower face sides) are formed inwards relative to the opening portion (see FIG. 4). When the gold-plated female terminal fitting 10Au is inserted into the cavity 41Au, the contacting members 15 that are exposed via the window holes 25 of the shell 20 make contact with the short circuiting terminal 42 (see FIG. 1).

The horizontal cross-sectional shape of the opening portion to the cavity 41Sn has a width and height such that the shell 30 can enter therein with a suitable clearance but without moving too much. The heights of the cavities 41Au and 41Sn for the gold-plated and tin-plated female terminal fitting respectively are identical. However, the cavity 41Au is narrower than the cavity 41Sn. Consequently, the tin-plated female terminal fitting 10Sn cannot be inserted into the cavity 41Au (see FIG. 9). Furthermore, the cavity 41Sn is not provided with guiding grooves 43. Consequently, the gold-plated female terminal fitting 10Au, which is provided with the stabilizers 27, cannot be inserted into the cavity 41Sn (see FIG. 5). The retaining members 44Sn, which correspond to the lances 34, are formed in the left and right side walls, at locations inwards from the opening portion, of the cavity 41Sn (see FIG. 8).

In this manner, although the gold-plated female terminal fitting 10Au and the tin-plated female terminal fitting 10Sn both use the same terminal main body 11, the shells 20 and 30, which are used respectively for the gold-plated and tin-plated terminal fittings, are provided with distinguishing means. These distinguishing means allow the gold-plated female terminal fitting 10Au and the tin-plated female terminal fitting 10Sn to be distinguished from one another. The distinguishing method thereof is described below.

The shell 20 has the window holes 25 formed therein, the contacting members 15 of the terminal main body 11 being exposed at outer faces of the shell 20 via these window holes 25. By contrast, the shell 30 is not provided with openings corresponding to the window holes 25. Consequently, the presence or absence of the window holes 25 (or, in other words, the ability to see the contacting members 15) allows one to distinguish between the gold-plated female terminal fitting and the tin-plated female terminal fitting.

The shell 20, which is provided with the window holes 25, has the lances 26 formed thereon at locations inwards relative to the direction of insertion of the shell 20 into the cavity 41Au. However, the position of these lances 26 is such that their paths of movement, when the shell 20 is inserted into the cavity 41Au, are separate from the paths of movement of the window holes 25 (this corresponding to the location of the short circuiting terminal 42 that makes contact with the contacting members 15 exposed from these window holes 25). Consequently, the lances 26 do not interfere with the short circuiting terminal 42 when this insertion takes place.

The shell 20 is provided with the holes 24 which prevent the bent members 14*a* and the anterior ends 14*b* of the resilient contacts 14 from interfering with the side walls 22. By contrast, the shell 30 is not provided with openings corresponding to these recessed holes 24. The presence or absence of these holes 24 (or, in other words, the ability to see the bent members 14*a* and the anterior ends 14*b* within the holes 24) allows one to distinguish between the gold-plated female terminal fitting and the tin-plated female terminal fitting.

The shell 20 and the shell 30 are provided with the lances 26 and 34, respectively. When the shell 20 and the shell 30 are inserted into the cavity 41Au and the cavity 41Sn, respectively, the lances 26 and 34 engage therewith. However, the lances 26 of the shell 20 are provided on the upper and lower face sides. By contrast, the lances 34 of the shell 30 are provided on the left and right sides. Consequently, the differing positions of the lances 26 and 34 allow one to distinguish between the gold-plated female terminal fitting and the tin-plated female terminal fitting.

Furthermore, since the contacting members 15 enter the window holes 25 of the shell 20, these contacting members 15 are located within the wall thickness of the side walls 22. Consequently, the space between the side walls 22 of the shell 20 is less than in the case of the shell 30, which does not have window holes 25 and in which the contacting members 15 are located inwards relative to the side walls 32. As a result, the shell 20 is narrower in width than the shell 30, this difference in width allowing one to distinguish between the gold-plated female terminal fitting and the tin-plated female terminal fitting.

The side walls 22 of the shell 20 (these side walls 22 being provided with the window holes 25) are closer together than in the case of the shell 30. Consequently, these side walls 22 are comparatively closer to the resilient contacts 14. However, since the holes 24 are formed in these side walls 22, the side walls 22 do not interfere with the resilient contacts 14. The side walls 32 of the shell 30 are not provided with window holes 25. However, the shell 30 is wider than the shell 20. Consequently, a greater space is provided between the side walls 32 and the resilient contacts 14, and the side walls 32 do not interfere with the resilient contacts 14.

Furthermore, the cavity 41Au and the cavity 41Sn differ in width, horizontal cross-sectional shape, in the location of the retaining members 44Au and 44Sn, and in the presence or absence of the guiding grooves 43. Consequently, if one attempts to insert into the cavity 41Sn the gold-plated female terminal fitting 10Au, which is provided with the stabilizers 27, these stabilizers 27 strike against the opening edge of the cavity 41Sn, and the gold-plated female terminal fitting 10Au cannot be inserted (see FIG. 5). Conversely, if one attempts to insert the tin-plated female terminal fitting 10Sn into the cavity 41Au, the shell 30 is wider than the cavity 41Au, and cannot be inserted therein. That is, the ability or inability to insert the gold-plated female terminal fitting or the tin-plated female terminal fitting into the cavities 41Au and 41Sn allow one to distinguish between the two female terminal fittings.

The present invention is not limited to the embodiments described above with the aid of figures. For example, the possibilities described below also lie within the technical range of the present invention. In addition, the present invention may be embodied in various other ways without deviating from the scope thereof.

(1) In the embodiment described above, differing types of female terminal fittings use identical terminal main bodies, and the shells function as a distinguishing means that allow one to distinguish between the differing female terminal fittings. However, according to the present invention, in addition to the shells, the terminal main bodies may also function as a distinguishing means.

(2) The shell for the gold-plated female terminal fitting in the embodiment described above may be attached to the terminal main body for the tin-plated female terminal fitting, and the shell for the embodiment's tin-plated female terminal fitting may be attached to the terminal main body for the gold-plated female terminal fitting. In that case, the shape of the cavities for the gold-plated female terminal fitting and the tin-plated female terminal fitting will be reversed from the shape described in the embodiment.

(3) In the embodiment described above, the cavities into which the female terminal fittings are inserted differ in size and shape. However, according to the present invention, the size and shape of these cavities may equally well be identical for both the gold-plated and tin-plated female terminal fittings.

(4) In the embodiment described above, two types of female terminal fittings (shells) have been described. However, the present invention may equally well be provided within three or more types of shell.

(5) In the embodiment described above, the contacting members of the terminal main body enter the window holes of the shell for the gold-plated female terminal fitting, and are consequently located within the side walls thereof. However, according to the present invention, the contacting members may equally well be located inwards relative to the side walls.

What is claimed is:

1. A system for distinguishing between female terminal fittings comprising:

a plurality of female terminal fittings, each female terminal fitting having a main body and a shell;

wherein the main bodies are each formed to have substantially the same structural configuration, and include a connection region for attachment to an electric wire and resilient contacts that are movable toward and away from each other for receiving and electrically engaging a male terminal fitting;

wherein at least one of the main bodies is gold-plated and at least one of the main bodies is tin-plated;

wherein each shell forms an enclosure that is fit over one of the main bodies, and includes a front end, a rear end with an opening through which the main body is received into the shell, and at least one lance;

wherein the lance for the shell received over each gold-plated main body extends laterally outward in a first direction relative to the main body received in the shell, and the lance for the shell received over each tin-plated main body extends laterally outward relative to the main body received in the shell in a second direction generally perpendicular to the first direction so that the female terminal fittings with the gold-plated main bodies can be distinguished from the female terminal fittings with the tin-plated main bodies, and wherein each shell further includes a rear segment with wall portions extending generally between the rear end and the lance, the rear segment of the shell received over each gold-plated main body includes a hole which exposes a portion of the gold-plated main body for contact with a short-circuit terminal, and the rear segment of the shell received over each tin-plated main body includes continuous wall portions without holes for exposing the tin-plated main body so that the female terminal fittings with the gold-plated main bodies can be further distinguished from the female terminal fittings with the tin-plated main bodies.

2. A system in accordance with claim 1, wherein each shell is rectangular in section and has a box-like structure.

3. A system in accordance with claim 1, wherein each shell defines a mouth adapted to guide the male terminal fitting to the resilient contacts.

4. An electrical connector assembly comprising:

a housing with cavities and a plurality of female terminal fittings from at least one of a pair of groups of the female terminal fittings being received within the cavities;

wherein each female terminal fitting has a main body and a shell;

wherein the main bodies are each formed to have substantially the same structural configuration, and include a connection region for attachment to an electric wire and resilient contacts that are movable toward and away from each other for receiving and electrically engaging a male terminal fitting;

wherein each shell forms an enclosure that is fit over the respective main body and includes a front end, a rear end with an opening through which the main body is received into the shell, and at least one lance between the front and rear ends;

wherein the lance for each shell in a first of the groups of female terminal fittings extends laterally outward in a first direction relative to the main body received in the shell, and the lance for each shell in a second of the groups of female terminal fittings extends laterally outward in a second direction relative to the main body received in the shell, the second direction being generally perpendicular to the first direction;

wherein the first group of female terminal fittings consists solely of tin-plated main bodies, and the second group of female terminal fittings consists solely of gold-plated main bodies; and wherein each shell includes a rear segment with wall portions extending generally between the rear end and the lance, the rear segment of the shell received over each gold-plated main body includes a hole which exposes a portion of the gold-plated main body for contact with a short-circuit terminal, and the rear segment of the shell received over each tin-plated main body includes continuous wall portions without holes for exposing the tin-plated main body so that the female terminal fittings with the gold-plated main bodies can be distinguished from the female terminal fittings with the tin-plated main bodies.

5. A connector assembly in accordance with claim 4, wherein the female terminal fittings with the gold-plated main bodies are received in the housing, and the housing includes a short-circuit terminal to contact the gold-plated main bodies through the holes in the shells.

* * * * *